United States Patent [19]

Bates

[11] Patent Number: 5,052,659

[45] Date of Patent: Oct. 1, 1991

[54] STAKE PULLER

[76] Inventor: Stephen M. Bates, 2314 SE. Pine, #6, Portland, Oreg. 97214

[21] Appl. No.: 674,320

[22] Filed: Mar. 25, 1991

Related U.S. Application Data

[63] Continuation of Ser. No. 505,595, Apr. 6, 1990, abandoned.

[51] Int. Cl.[5] ..... E21B 19/00

[52] U.S. Cl. ..... 254/29 R; 254/30

[58] Field of Search ..... 254/8 R, 8 B, 29 R, 254/30, 31; 172/111, 439

[56] References Cited

U.S. PATENT DOCUMENTS

| | | | |
|---|---|---|---|
| 1,202,551 | 10/1916 | MacKenzie | 254/29 R |
| 1,295,700 | 2/1919 | Cook | 254/29 R |
| 2,807,494 | 9/1957 | Bulfer, Jr. | 254/29 R |
| 2,874,934 | 2/1959 | Dannehl | 254/29 R |

*Primary Examiner*—J. J. Hartman

*Attorney, Agent, or Firm*—Eugene M. Eckelman

[57] ABSTRACT

A body member has an upright bore for receiving a stake to be pulled. When the body member is tilted, edges of the bore grip the stake. A flexible link has one end connected to the body member and its other end arranged to receive a lever that is used to impart an upward lift on the flexible link which in turn tilts the body member for gripping the stake and applying an upward pulling force to the stake.

1 Claim, 1 Drawing Sheet

STAKE PULLER

This application is a continuation, of application Ser. No. 07/505,595, filed Apr. 6, 1990 now abandoned.

BACKGROUND OF THE INVENTION

This invention relates to new and useful improvements in stake pullers.

In constructing foundations and other ground supported portions of buildings and the like, many stakes are used that are pounded into the ground. These stakes for example brace the forms that receive the cement foundations. After they have served their purpose, the stakes are pulled out. Since a firm bracing support must be accomplished by the stakes, they are usually driven in quite deeply which of course makes them difficult to pull out. In most instances they will be loosened by tapping them sideways with a sledge until they are sufficiently loose to pull up by hand. This type of stake pulling method is time consuming and tiring. Also, in many instances, personnel will attempt to pull up the stakes by hand while they still are firmly stuck in the ground. This has resulted in many physical injuries. Furthermore, the stakes are often located immediately adjacent to the forms and thus are hard to manipulate for grasping and pulling. Such also contributes to further possibility of injury to workmen.

SUMMARY OF THE INVENTION

According to the present invention and forming a primary objective thereof, a stake puller is provided that is convenient to use, that is effective in operation, that can remove stakes rapidly without physically straining the workman, and that will readily grip a stake even though the latter is immediately adjacent to a form member.

A further objective of the invention is that it can be used with substantially any available type of lever and particularly levers that are readily available on the market and more particularly yet levers that normally are available on the job.

Yet another object is to provide a stake puller that is simple in structure and inexpensive to manufacture. Also, the present stake puller is small and compact and thus can be carried on one's person throughout the work day.

In carrying out the objectives of the invention, a stake engaging member is structured so that when it is tilted relative to a stake, it grips the stake and provides a connection therewith for lifting the stake. A flexible link has one end connected to the stake engaging member and is arranged to tilt the latter when an upward lifting force is applied to the other end of the flexible link. The flexible link is arranged to be operated by a lever capable of applying an upward force thereto for binding the stake engaging member on the stake in a stake gripping and pulling operation. The flexible link is adjustable in length and preferably comprises a link type chain. The stake engaging member has an upright bore therein which utilizes opposite gripping edges for connection to the stake in a lifting operation.

The invention will be better understood and additional objects and advantages will become apparent from the following description taken in connection with the accompanying drawings forming a part of the invention.

DETAILED DESCRIPTION OF A PREFERRED EMBODIMENT

Figure 1:
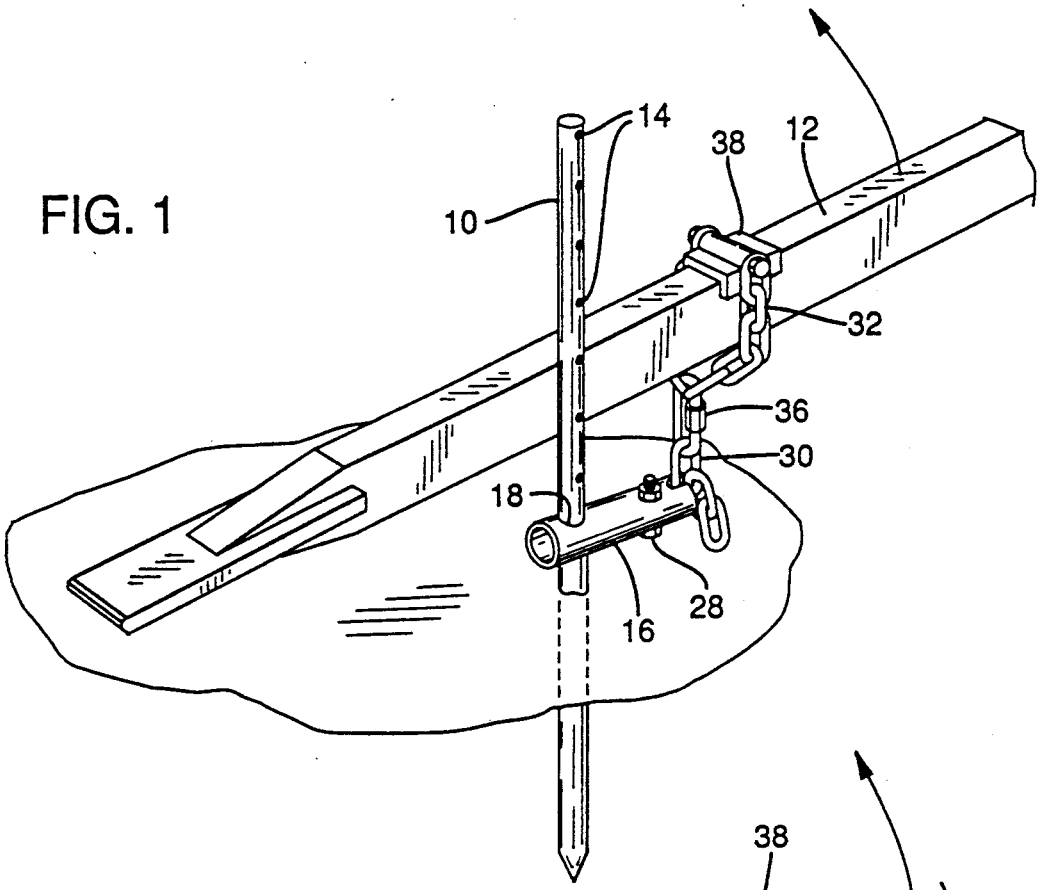
FIG. 1 is a perspective view of the present stake puller, the stake puller being shown mounted on a stake in a pulling position and operated by a conventional bar that serves as a lever.

With particular reference to the drawings, the invention is designed for pulling stakes 10 of a type that are commonly used in construction for bracing forms and the like. The invention is also designed for operation with a lever 12 of a type that is commonly available and in most instances already existing on the job. The stakes usually have a plurality of spaced holes 14 therein.

The stake puller of the invention has a body member 16 with an upright bore 18 therein spaced a short distance rearwardly from its front end. The bore is of a size to freely receive the stake, and also in its relation with the body member this bore forms top and bottom binding edges 22 and 24 on the stake when the body member is pulled upward and tilted from the rear. The edge 22 comprises the primary gripping edge when bound against the stake and enough friction is developed to provide a lifting connection with the stake.

The rear portion of the body member has anchor means 28 such as a bolt or pin for the lower end of a flexible link 30 that has an upper loop 32 formed therein for freely receiving a lever bar 12. Body member 16 has an upright diametral slot 34 at its rearward end in which the flexible link can work without binding engagement with the body member.

In the operation of the present stake puller, the body member is slipped down over the projecting end of the stake with bore 18 receiving the stake. A suitable lever 12 is then inserted in the loop 32 of the flexible link 30, and by leveraged operation of the lever, the body member 16 tilts up at the rear to cause the edges 22 and 24 to have secured gripping connection to the stake. The loop 32 has a frictional grip on the lever in this leveraged operation up to a certain tilt position of the lever. The stake will be pulled upward with little effort by the workman when the lever is operated at the rear. It may be necessary to work the stake out in short re-gripping steps and relocate the body member each time since the best leverage is obtained when the lever is close to horizontal, and furthermore if the lever tilts up too much the loop may lose its frictional grip on the lever. Each time the lever is lowered, the body member 16 will slide down for obtaining a new secured connection.

Figure 2:
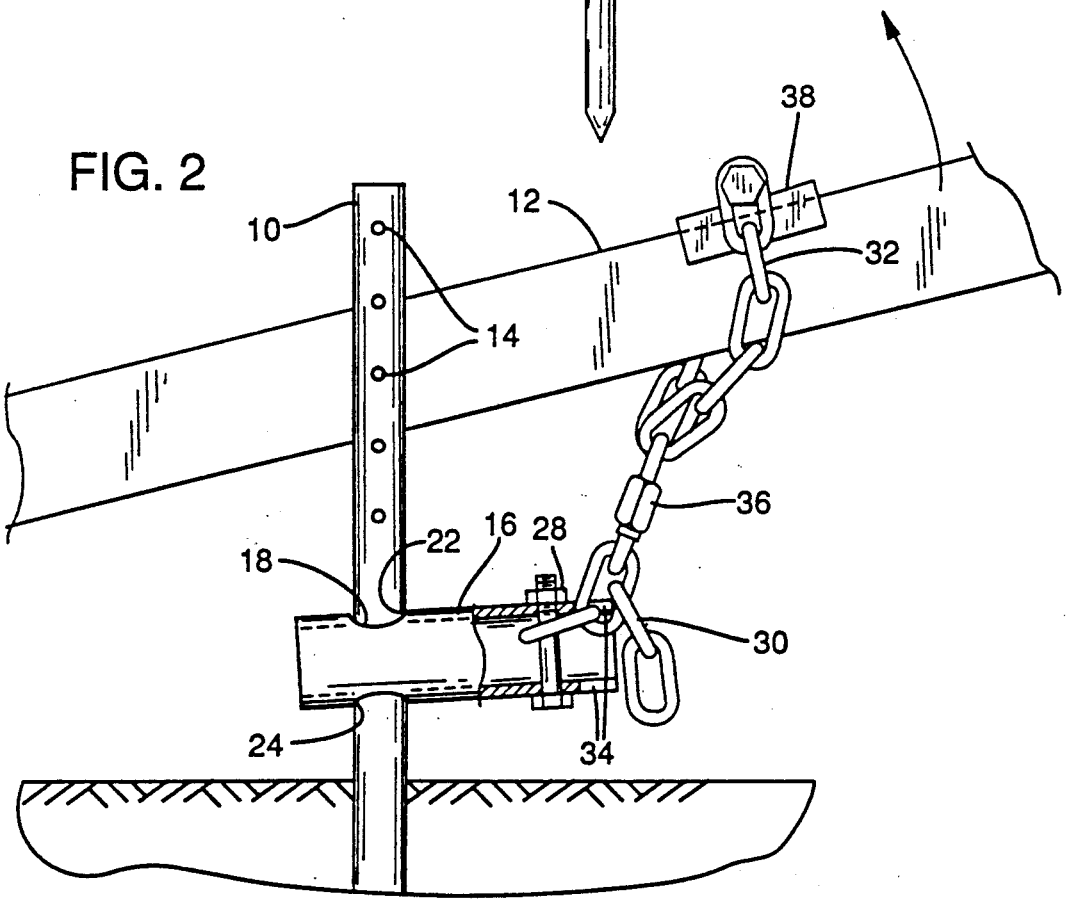
FIG. 2 is a side elevational view of the present stake puller, the puller also being shown in combination with a stake and lever, a portion of the puller being broken away.

In applying the leverage for upward gripping engagement with the stake, the loop 32 of the flexible link must engage the lifting end of the lever relative to the stake, namely, the right side as seen in FIG. 2. In this way, the loop 32 swings toward the stake when the lever pivots upwardly and such ensures a good gripping connection of edges 22 and 24 on the stake. The engagement of loop 32 on the lever can be on the other side of the stake, namely, on the left side of FIG. 2 if nails or pins, not shown, are inserted in selected ones of the holes 14 above the body member to keep it from sliding upwardly.

In a preferred structure, the body member 16 is tubular as shown to provide good gripping edges 22 and 24. Such also contributes to making an economical product since this type of tubular stock is readily available. The construction of the body member 16 allows it to be mounted on stakes that are closely adjacent to walls or form parts. As stated, the bore is of a size to freely receive a stake. In addition, the bore preferably is of a diameter that will receive a slightly mushroomed top end of the stake. The bore is not so large however as to receive an overly mushroomed end thereby discouraging the use of overly-mushroomed stakes and minimizing any potential danger from flying metal which would occur when a worn out stake is used.

Also, in a preferred structure, the flexible link 30 comprises a link chain. By means of this structure, the flexible link can be varied in length simply by selecting proper link engagement on the anchor means 28. This length adjustment may be important if an obstruction is in the way, for example, since the chain may be easily lengthened if necessary. Also, the link chain can have a releasable connector 36 adjacent the loop 32 for the purpose of making this loop of a selected size to accommodate the cross sectional shape or size of the lever to be used. As shown, the loop accommodates a rectangular nail pulling bar 12 and is custom constructed with an integral inverted channel member 38 that fits on top of the bar. A plain loop, however, will ordinarily suffice for good working connection to most levers.

The present stake puller is thus versatile and convenient in use and economical to manufacture. Mainly, it makes the job of pulling stakes extremely easy and minimizes possible injury to workmen. It accommodates almost any type of lever and particular levers in the form of devices that already exist on the job and can be easily carried in a tool box or on the person.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A manually operated stake puller comprising:

a stake engaging member comprising an elongated tubular body member having forward and rearward ends, a first cross bore in said forward end of said body member of a size that freely receives a stake but when tilted upward at its rearward end its binds against the stake provides a connection therewith, a flexible link having one end connected to a second cross here in the rearward end of said stake engaging member for tilting the latter when an upward lifting force is applied to the other end of said flexible link, length adjustment means in said flexible link, an elongated manually operated lever, loop means on said other end of said flexible link slidably and removably receiving said manually operable lever in which when said lever is inclined relative to the stake and leveraged upward by a workman standing on the ground said lever applies an upward force to said flexible link for tilting said stake engaging member and binding the latter on the stake in a stake pulling operation.

* * * * *